US005242161A

United States Patent [19]

Wilkirson

[11] Patent Number: 5,242,161

[45] Date of Patent: Sep. 7, 1993

[54] DEVICE TO CUSTOMIZE GOLD TEE HEIGHT

[76] Inventor: W. K. Wilkirson, 4807 Canyonwood, Austin, Tex. 78735

[21] Appl. No.: 818,807

[22] Filed: Jan. 9, 1992

[51] Int. Cl.[5] ..... A63B 57/00

[52] U.S. Cl. ..... 273/32.5; 273/32 B; 273/203

[58] Field of Search ..... 273/33, 32.5, 202-212, 273/203

[56] References Cited

U.S. PATENT DOCUMENTS

| | | | |
|---|---|---|---|
| 1,194,860 | 8/1916 | Merrill | 273/203 |
| 1,616,059 | 2/1927 | Mulvehill | 273/202 |
| 1,738,596 | 12/1929 | McLeod | 273/203 |
| 1,846,407 | 2/1932 | Thompson | 273/33 |
| 3,516,664 | 6/1970 | Brennan | 273/33 |
| 3,606,344 | 9/1971 | Ball | 273/202 |
| 3,883,144 | 5/1975 | Lazou | 273/33 |
| 5,052,689 | 10/1991 | Lettrich | 273/202 |

*Primary Examiner*—Theatrice Brown
*Attorney, Agent, or Firm*—Steven J. Rosen

[57] ABSTRACT

A device to customize a golf tee height by placing a golf tee through the center of a hollow stem of a device with detachable segments that allow the golfer to remove sections of the stem in order to adjust the height of the tee.

3 Claims, 2 Drawing Sheets

DEVICE TO CUSTOMIZE GOLD TEE HEIGHT

BACKGROUND FIELD OF INVENTION

This invention describes a golf tee elevation-determination device that accurately controls the height of a golf tee by detachable segments that comprise the stem of the device, has no mechanical parts, is easy to use, and inexpensive.

A proper golf swing requires multiple variables to be executed simultaneously and perfectly. Golf rules allow the ball to be elevated at the tee box, which is accomplished by a golf tee placed into the ground and upon which a golf ball is placed. The height of the ball at the tee box is thus determined-by the height of the tee. If the ball height is wrong, the entire swing, no matter how otherwise perfect, is doomed from the beginning. If the ball (tee) is set too high; the ball will go very high, but will not obtain the desired horizontal distance. Inversely, if the ball (tee) is set too low, the ball will fail to reach the optimal vertical distance, reducing the desired horizontal distance. Thus each golfer must determine what the precise optimal height of the ball (tee) is for his or her individual swing and consistently reproduce that height at each tee box; the difficulty is compounded by the requirement by some golfers for a different tee height for a long club and for a short club.

DESCRIPTION OF PRIOR ART

U.S. Pat. No. 3,889,946 to Setecka (1975) is a mechanical device to position a tee into the ground without the golfer bending over to do so. It also adjusts the tee height by a slidable stop member on a shaft positioned above the ball. The preferred embodiment requires a specially designed tee in order for this prior art to work best. My invention differs from this elongated handled tool in that my device has no adjustable mechanical parts, is smaller and easier to use, and is substantially less expensive.

U.S. Pat. No. 3,904,200 to Jackle, et al. (1975) is a spring activated device to position a golf ball into the ground without the golfer bending over to do so. It adjusts the height of the tee with two adjustable legs. In order for the device to obtain a level tee head, at least one leg must be readjusted to compensate for unlevel surfaces. This device also punches two additional holes into the ground, unlike my device. My invention also differs from this elongated handled tool in that my device is not spring activated, has no adjustable mechanical parts, is smaller, easier to use, and substantially less expensive.

U.S. Pat. No. 3,671,036 to Rubino (1972) is a nonmechanical device that sets a tee into the ground so that the distance is the same each time. The major problem with this device is that it does not allow the golfer to adjust the tee height to optimally position the ball for the height required by the swing of each golfer. My device provides the critical adjustment through the novel and unique concept of incorporating removable segments into the device. Another improvement adds a flange at the bottom of the device so that when the tee is forced into the ground, the bottom of the device is not pushed into the ground. Therefore, my embodiment is easier to use and more accurate.

U.S. Pat. No. 3,658,331 to Driscoll (1972) is a device that measures the height of a tee. It requires a coin to be placed into grooves in its supporting legs; the engaged coin is then placed on top of the tee head for measuring the height of the tee. Unlike this prior art, my device controls the height of the tee by stopping its movement at the ground by the device engaging the upper portion of the neck of the tee or the ball. This prior art requires a four step operation in the tee box to set and accurately position the ball, unlike my two-step operation.

A patent pending device is being offered for sale (copy of advertisement is enclosed). It has 25 referenced tees, and 5 slides. My invention was developed by me independent of this prior art and without knowledge of its existence. Tees are broken and lost; therefore, my device uses the standard (inexpensive) golf tee, available for sale at all golf courses and all sporting good stores, and still obtains great tee accuracy. My device also allows the height of the tee to be more precisely customized. Small slides used in this prior art can be difficult to retrieve in the grass in and around the tee box after the ball is hit. My device also has an optional flanged bottom to more accurately position the tee by preventing the device from being pushed into the ground as the tee is pushed into the ground, a real problem with wet or alluvial soil. My device is simpler because with my device the golfer does not have to fiddle with and keep track of so many small parts. This prior art device is substantially more expensive than the envisioned price of my simpler device.

Objects and advantages

Accordingly, several objects and advantages of my invention that achieves a customized tee height that is accurate, consistently reproducible, and helps produce an optimal drive are:

a) ability of golfer to adjust height of tee-adjusting device;
b) a device for accurately adjusting the tee height for a consistent and reproducible height without selecting from or combining of nonmating small slides;
c) a two-step operation for controlling the tee height;
d) an inexpensive device for adjusting the tee height;
e) an easy, simple device for adjusting the tee height;
f) a device that is easy to retrieve from the grass, after completion of the swing, unlike small slides;
g) a device that can accurately adjust the tee height for a consistent and reproducible height and be removed before the ball is hit;
h) eliminates need for large, bulky long-handled mechanical devices;
i) provides support to the stem of the tee, thus reducing the frequency of tee breakage during the golf swing.

Further objects of my invention will become apparent from a consideration of the drawings and ensuing description of it.

DRAWING FIGURES

REFERENCE NUMERALS IN DRAWINGS

Figure 1:
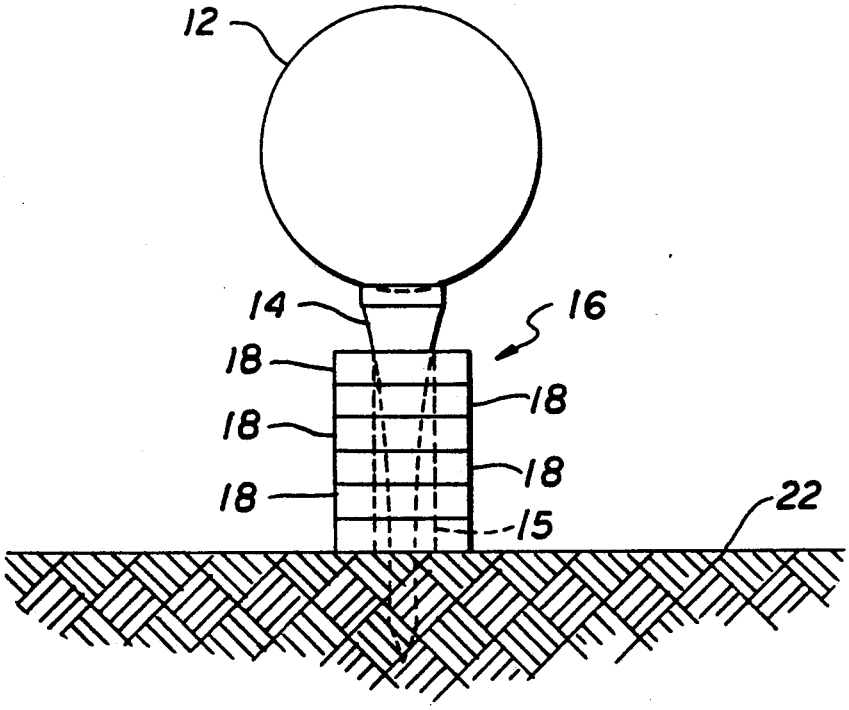
FIG. 1 shows the tee height adjustment device.

12 ball
14 tee
16 stem
18 detachable segment
20 flanged bottom 22 ground
24 notch

DESCRIPTION

Figure 2:
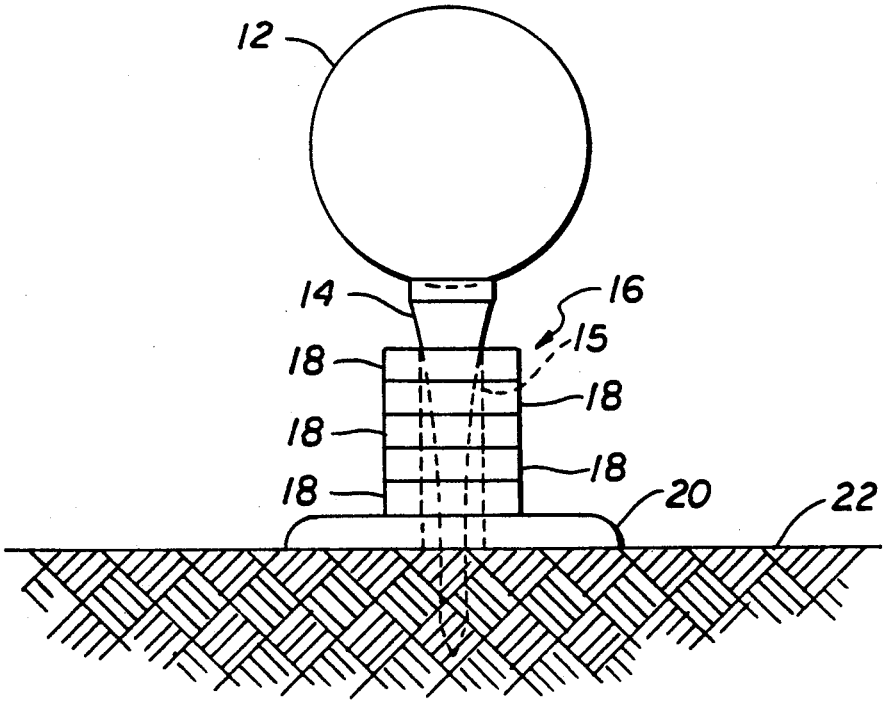
FIG. 2 shows the tee height adjustment device with optional flanged bottom.

FIG. 1 and FIG. 2 show a device that holds a golf tee, 14, a predetermined distance out of the ground, 22, when tee, 14, is inserted into ground, 22 and allowing the height of the ball, 12, to meet the requirement of each golfer and said height is consistently accurate and easily reproducible. The uniqueness and novelty of the device arises out of the stem, 16, that is 1 comprised of detachable segments, 18 which allow the height of tee, 14, to be accurately controlled to a customized height as tee, 14, is inserted into ground, 22.

Detachable segments, 18, allow part of stem, 16, to be readily removed which thus provides the customized tee height. Detachable segments, 18, can be manufactured so that reassembly is precluded or so that the bottom of each detachable segment, 18, is shaped so that it can engage the top of another detachable segment, 18, when mated together.

The device is generally cylindrical shaped, and has a hollow cavity through the length of stem, 16, thus allowing the shank of tee, 14, to be inserted through it. The top of the device will meet the cup-shaped bottom of tee, 14 at a point just below the maximum circumference of tee, 14. Tee, 14, has a standard circumference at its top because of the standard size of ball, 12. This standard circumference being only slightly larger than the circumference of the hollow cavity of stem, 16, thus reducing the effect of the nonuniformity of the length of the taper from the shank of tee, 14 and eliminating the need for reference tees as required by some prior art. Stem, 16, of the device is no longer than a height which permits tee, 14, to be set at the maximum height.

FIG. 2 shows a flange, 20, attached to the bottom of the device in order to support the device and prevent it from being forced into ground, 22, when tee, 14, is forced into ground, 22, and to more easily achieve perpendicularity of tee, 14, to ground, 22, which is required for ball, 12, to remain at rest on top of tee, 14. The hollow cavity of flange, 20, is of smaller circumference than the circumference of stem, 16, in order help achieve perpendicularity of tee, 14, to ground, 22, which is required for ball, 12, to remain at rest on top of tee, 14.

Figure 3:
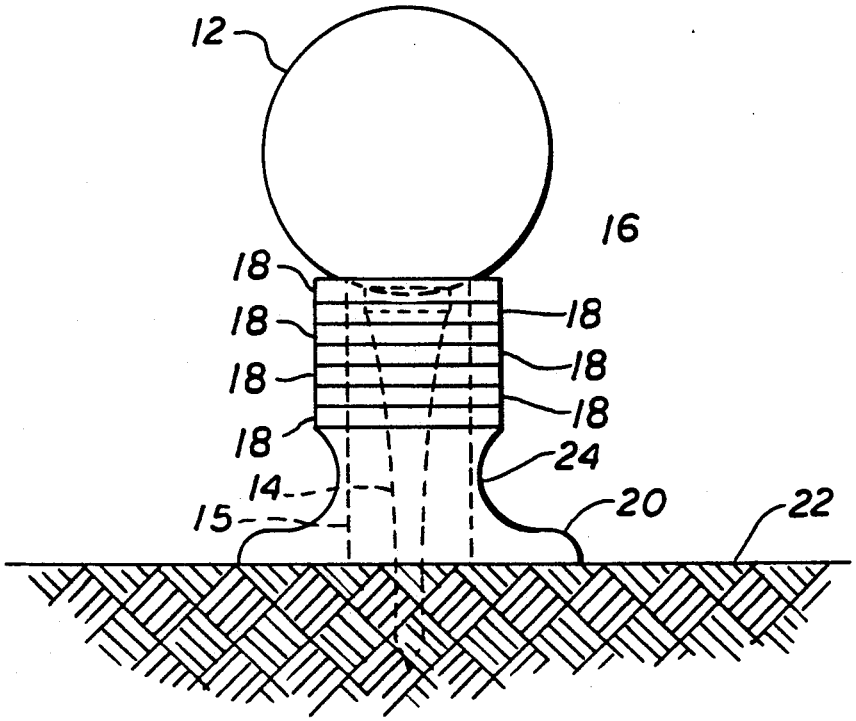
FIG. 3 shows an embodiment improving the Rabino patent by adding a flanged bottom and detachable segments.

FIG. 3 shows another embodiment, an improvement to the device in the Rabino patent. That device, as issued, does not allow the golfer to customize the height of the device, which precludes the adjustment of the height of tee, 14, and ball, 12. The first novel and unobvious improvement to that device is the incorporation of detachable segments, 18, at the top and/or bottom of the device, which will allow part of the top or bottom to be easily removed, thus resulting in the customized height of tee, 14. This improvement thus adds to this prior art a new function, adjustability of height of tee, 11, and a new result, adjustability of height of ball, 12. The second novel and unobvious improvement is the addition of a flange, 20, attached to the bottom of the device in order to support the device and prevent it from being forced into ground, 22, when tee, 14, is forced into ground, 22, and to more easily achieve perpendicularity of tee, 14, to ground, 22, which is required for ball, 12, to remain at rest on top of tee, 14.

Another feature that may be used in the present invention are notches 24 near the bottom of the stem 16 preferably just above the flanged bottom 20 of the stem 16. The notches 24 help the user more easily grip the device and push the tee 14 into the ground.

Ease of use can be increased by marking or otherwise identifying each removable portion of the device under this patent in such a way that the golfer will be able to easily recall which height was selected (i.e. what was the last mark at the top of the stem). This marking will help in the event that a previously adjusted device is lost, or damaged. Such markings could be alphabetic, numeric, or color indicators.

Operation

With FIG. 1 and FIG. 2, the golfer would first determine the optimal height of the tee and then adjust (remove portion(s)) of the stem of the device to equal that height of the tee that is not pushed into the ground upon which the ball sets. The tee is then inserted into the cavity of the device, pointed end through the top of the stem, and pointed end of tee positioned toward the ground. Then either with or without the ball-resting on the cup-shaped top of the tee, the golfer would insert the tee into the ground until the bottom of the device meets the ground and the ,top of the stem meets the cup-shaped portion of the tee at a point just below the tee's maximum circumference. With FIG. 2, the flange attached to the bottom of the device would touch the ground. After the ball is hit, the tee and device are removed from the ground.

With FIG. 3, the golfer would first determine the optimal height of the tee and then adjust (remove portion(s)) of the stem of the device to equal that height allowing for the device to rest upon the circumference of the ball which is equal to the inside circumference of the top of the device. The ball is held by the palm of the golfer's hand while the bottom of the ball is placed upon the top of the tee. The tee is then placed into the top of the cavity of the stem, pointed end of the tee through the top of the stem and pointed end of tee positioned toward the ground. A digit of the golfer's hand is then placed upon each notch and together the two digits hold the tee against the bottom of the ball while the palm of the golfer's hand applies pressure on the top of the ball. The ball rests upon the top of the device. The pointed end of the tee is placed into the ground until the downward motion is stopped by the bottom of the device (or the flange attached to the bottom of the device). The ball is removed; device is removed, and the ball is replaced upon the top of the tee.

Summary, Ramifications, and Scope

This invention provides a simple, easily used, yet surprisingly effective device for enabling a golfer to customize the height of a golf tee and therefore the golf ball itself. No device exists that allows a golfer to select the height of the tee height adjustment device by removing sections of its stem. This ability is superior to preset slides because the golfer does not have to keep track of small slides nor combine or multiple small pieces to achieve a truly customized tee height. The flanged bottom option prevents the bottom of the stem of the device from being pushed into the ground when the tee is forced into the ground. Several objects and advantages of my invention for a customized tee height that will facilitate an optimal drive are:

a) ability of golfer to adjust height of tee-adjusting device;

b) a device for accurately adjusting the tee height for a consistent and reproducible height without selecting from or combining of nonmating small slides;
c) a two-step device for controlling the tee height;
d) an inexpensive device for adjusting the tee height;
e) an easy, simple device for adjusting the tee height;
f) a device that is easy to retrieve from the grass, after completion of the swing, unlike small slides;
g) a device that can accurately adjust the tee height for a consistent and reproducible height and be removed before the ball is hit;
h) eliminates need for large, bulky long-handled mechanical devices;
i) provides support to the stem of the tee, thus reducing the frequency of tee breakage.

Thus this invention provides a novel and unobvious device for easily customizing a golf tee height with the added benefit of ease of reproducibility of that customized height.

While my above description contains many specificities, these should not be construed as limitations on the scope of the invention, but rather as an exemplification of preferred embodiments thereof. Many other variations, shapes, and configurations are possible. The scope of the invention should be determined by the entire patent application.

I claim:

1. In combination, a golf tee and a device to aid in inserting the golf tee into the ground a predetermined depth, said golf tee having a cylindrical shank pointed at one end and an enlarged cup-shaped golf ball support at its opposite end, a) said device being a generally cylindrical shaped stem,
b) said stem having a hollow cylindrical cavity through its longitudinal center, said cavity being of sufficient diameter to allow said tee to pass completely through said cavity thus allowing a golf ball to simultaneously rest upon the top of said cup-shaped ball support and one end of said stem at a ball teed position while said shank and ball support of and to allow said stem to be removed from said ball teed position without disturbing said tee said tee is disposed inside said cavity, said cup-shaped ball support and one end of said stem at a ball teed position while said shank and ball support of and to allow said stem to be removed from said ball teed position without disturbing said tee
c) said stem having sufficient length to allow said pointed end of said shank to penetrate the ground to a predetermined depth and
d) said stem further having a plurality of detachable and reattachable segments to allow a portion of said plurality of segments to be removed and reassembled for adjusting the height of said ball support above the ground.

2. An apparatus as claimed in claim 1 further comprising a flange attached to the other end of said stem.

3. An apparatus as claimed in claim 2 further comprising an annular notch between said other end of said stem and above said flange.

* * * * *

UNITED STATES PATENT AND TRADEMARK OFFICE

CERTIFICATE OF CORRECTION

PATENT NO. : 5,242,161

DATED : Sept. 7, 1993

INVENTOR(S) : Walter K. Wilkerson

It is certified that error appears in the above-indentified patent and that said Letters Patent is hereby corrected as shown below:

Title page, item [19] change "Wilkirson" to --Wilkerson--

On title page, item [54] and col. 1, change "Gold" to --Golf--

On title page, item [76] change "Wilkirson" to --Wilkerson--.

Signed and Sealed this

Twenty-second Day of March, 1994

*Attest:*

*Attesting Officer*

BRUCE LEHMAN

*Commissioner of Patents and Trademarks*